United States Patent [19]

Welsch

[11] 4,327,504

[45] May 4, 1982

[54] CIRCULAR SNOWSHOE

[76] Inventor: Donald W. Welsch, Star Rte. 1, Box 110, Trout Creek, Mont. 59874

[21] Appl. No.: 209,461

[22] Filed: Nov. 24, 1980

[51] Int. Cl.[3] ..... A43B 5/04

[52] U.S. Cl. ..... 36/122

[58] Field of Search ..... 36/122, 123, 124, 125

[56] References Cited

U.S. PATENT DOCUMENTS

| | | | |
|---|---|---|---|
| 2,097,249 | 10/1937 | Keene | 36/4.5 |
| 2,430,466 | 11/1947 | Hedman | 36/7.5 |
| 2,615,260 | 10/1952 | Paden | 36/122 |
| 3,596,374 | 8/1971 | Covington | 36/4.5 |
| 3,798,801 | 3/1974 | Gros-Louis | 36/122 |
| 3,885,327 | 5/1975 | Maki | 36/2.5 |

FOREIGN PATENT DOCUMENTS

| | | | |
|---|---|---|---|
| 2829853 | 1/1979 | Fed. Rep. of Germany | 36/122 |

*Primary Examiner*—Patrick D. Lawson

*Attorney, Agent, or Firm*—Wells, St. John & Roberts

[57] ABSTRACT

A snowshoe is described with a highly mobile circular frame. A woven webbing extends across the frame with a binding attached to an upper surface thereof. The frame includes an inclined annular surface that faces inwardly and downwardly to enable an outer annular edge of the frame to bite into the snow for traction in rough terrain. The snowshoe, due to its circular nature, can be constructed nearly entirely of vehicle tire components.

10 Claims, 3 Drawing Figures

CIRCULAR SNOWSHOE

BACKGROUND OF THE INVENTION

The present invention relates generally to snowshoes and more particularly to such snowshoes that are highly maneuverable in rough terrain.

Snowshoes are probably one of the oldest forms of snow transportation known to man. Still, their construction has not changed significantly over the centuries. Old styles were made of wooden frames with rawhide ribbing and leather or cloth bindings. Scarcity of natural materials and increased cost of labor have made the original forms extremely expensive.

There are several types and variations of snowshoes used for various purposes and snow conditions. Long, narrow snowshoes are used typically in open relatively flat areas where speed is more important than maneuverability. Shorter, flat snowshoes are often used more in steep, brushy country where more maneuverability is required. The toe end of a flat snowshoe can be kicked into the snow on a steep hillside to provide a "toe hold" that can bear the weight of the wearer, where upwardly curved snowshoes would fail.

The length of a snowshoe has a significant effect on maneuverability. Longer snowshoes must be handled with a technique similar to skis and will not allow the wearer to move freely in confined areas.

In response to the maneuverability problem, a series of "bearpaw" types of snowshoes have been developed. "Bearpaw" snowshoes are substantially wider and shorter than the regular "Maine" or "Michigan" types. The "bearpaw" form varies, though the typical configuration is wide and oblong in the intended direction of travel. Thus, the maneuverability problem still remains due to the shoe length.

Modern construction materials have been adapted to snowshoe configurations in recent years. Lightweight metal frames are now in common use with nylon or neoprene webbing and bindings. Plastic snowshoes are also known. The basic snowshoe configuration, however, has remained relatively unchanged, along with inherent maneuverability problems.

The present snowshoe incorporates functional design and materials in a unique manner to produce a significant improvement in snowshoe maneuverability and affordability. The overall shape of the present snowshoe is circular as opposed to oblong. The bindings are near the center of the circular configuration. The wearer can thus turn in any direction without excessive manipulation of the snowshoe. Furthermore, outer edges of the present snowshoe are downturned rather than being flat or upturned as previously known, to allow a greater bite into the snow for climbing or descending steep areas. The present snowshoe can be formed economically from available material such as rubber tire casings and innertubes.

BRIEF DESCRIPTION OF THE DRAWINGS

A preferred form of the present invention is illustrated in the accompanying drawings in which.

DETAILED DESCRIPTION OF A PREFERRED EMBODIMENT

Figure 1:
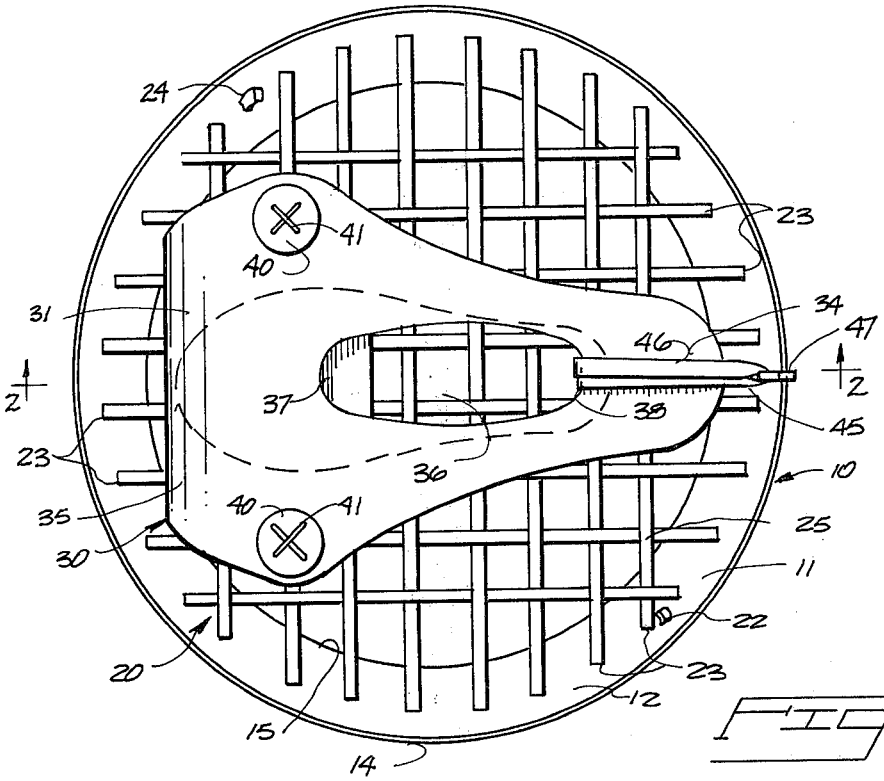
FIG. 1 is a top plan view of the present circular snowshoe with a dotted outline of a wearer's boot thereon.

A preferred form of the present snowshoe is generally designated by the reference number 10 in the accompanying drawings. The circular snowshoe 10 is provided as an economical and improved alternative to "bearpaw" type snowshoes that have previously been used for general snowshoeing and most effectively in steep or confined areas such as those most frequently encountered by trappers. The circular configuration of the present snowshoe allows significantly more maneuverability than any other known form of snowshoes. The circular nature of the present shoe allows the wearer to turn abruptly to any angular position without "maneuvering" the snowshoes excessively. The shoes will turn on their center axes and, because the front and back sides are identical, will not interfere with the wearer's legs. Additionally, the surface area spanned by the present shoe structure is sufficient to support weights equivalent to capabilities of conventional forms of snowshoes.

The present snowshoe 10 includes an annular frame 11. The frame 11 includes an upwardly facing top surface 12 and an opposed downwardly facing bottom surface 13. The surfaces 12 and 13 are joined by an outer annular edge 14 and an inner annular edge 15. The surfaces and edges comprising the frame are formed about a central axis for the frame. The outer annular edge 14 is spaced along the central axis from the inner edge 15. This relationship causes the bottom surface 13 to be inclined, facing down and inwardly toward the central axis.

Figure 2:
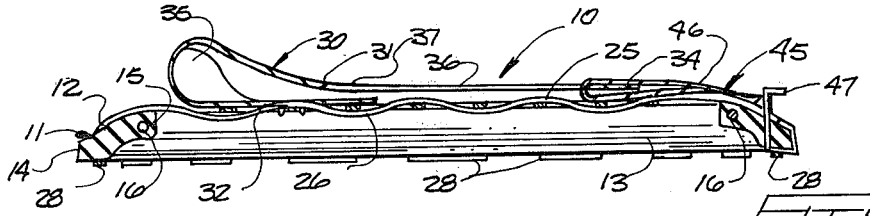
FIG. 2 is a cross-sectional view taken along line 2—2 in FIG. 1.

The annular frame 11 may be provided with an annular reinforcing band 16 as shown in FIG. 2. The band 16 is preferably formed of a somewhat rigid material between the surfaces 12 and 13. The band 16 will provide structural reinforcement about the frame and will add to axial stability thereof.

Figure 3:
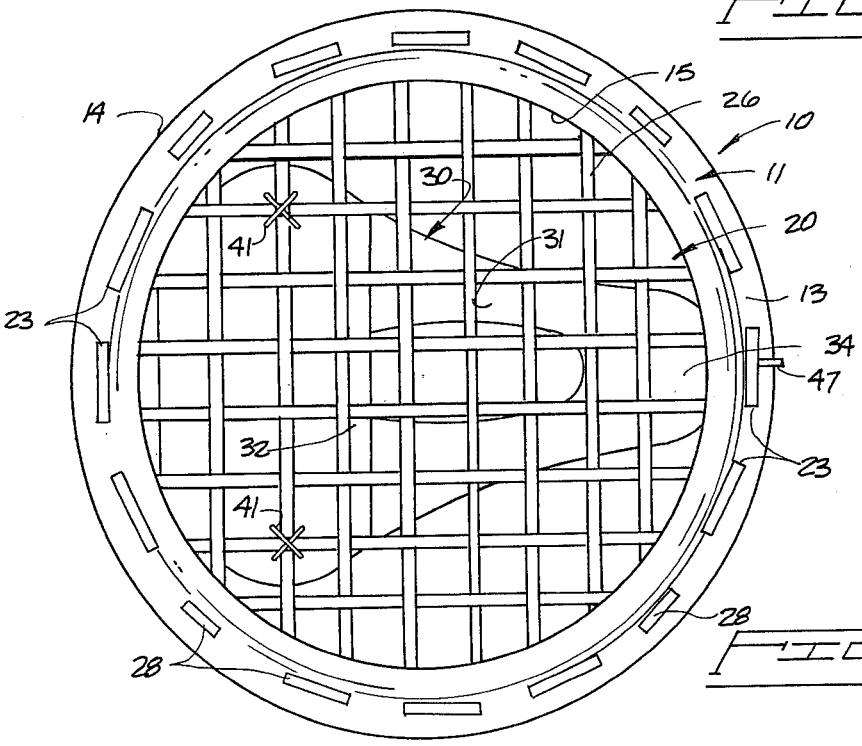
FIG. 3 is a bottom plan view of the present snowshoes.

A web is shown at 20 spanning the frame 11. The web is mounted to the frame along the top surface and is spaced axially from the bottom surface 13 as shown in FIG. 2. It is preferred that the web be formed of a single elongated strand of a resilient material (such as rubber). This elongated strand is threaded from an end 22 (FIG. 1) through a succession of holes 23 in the frame 11. The length of the strand is woven onto itself as it is progressively inserted through the holes 23. The remaining end of the strand is shown at 24 in FIG. 1 at a point nearly diametrically opposite the remaining end 21 on the frame. The woven strand as shown in FIGS. 1 and 3 forms a "criss-cross" pattern across the frame that substantially overlaps the top surface of the frame. The web includes an upwardly facing top side 25 and a bottom side 26 that faces downwardly and engages the top surface 12 of the frame at the web periphery.

Short sections of the web produce a number of downwardly projecting cleats 28 (FIGS. 2 and 3) about the frame. The cleats 28 are integral with the web 20, being formed as "stitches" about the frame bottom surface. The cleats 28 function directionally to resist sliding motion of the snowshoe once weight is applied thereto. This is a distinct advantage on inclines when the wearer is attempting to climb or descend without "kicking" the edges of the shoe through the snow surface.

A binding means 30 is provided on the top surface 25 of the web for securing the snowshoe to the user's foot. The binding means 30 is preferably comprised of an elongated resilient sheet 31 having a front end 32 and a heel end 34. The front end of the sheet 31 is folded onto itself as shown in FIG. 2 to form a toe pocket 35. The toe of the user's boot is received within the pocket 35. Access to the toe pocket is gained through a foot opening 36. The opening 36 extends from a front end 37 adjacent the toe pocket 35, to a back end 38 adjacent the heel 34. The foot opening 36 is thus elongated and is somewhat centered over the central axis of the frame.

The elongated sheet 31 is secured to the web 20 at positions laterally adjacent the front end 37 of the foot opening 36. Tie down cords 41 are used for this purpose. The cords 41 are threaded through appropriate buttons or rosettes 40 and through the double thickness of the sheet 31 to be secured to the web 20. FIG. 3 shows the attachment of the tie down cords to the web. It is noted that in place of the flexible rosettes, grommets (not shown) can be used for receiving the cords. Brass or another noncorrosive material would be preferred for such grommets.

The heel end 34 of the binding means is held in place by a hold down means generally shown at 45. The hold down means may be comprised of a resilient strap 46 releasably secured to a hook 47. The hook 47 is affixed to the frame 11 directly behind the heel end of the binding means. The hold down means, including the strap 46 and hook 47, is best shown in FIGS. 1 and 2.

The strap 46 normally extends from one end releasably secured to the hook 47 to a remaining end attached to the elongated sheet 31. Preferably, the strap is in the form of a closed loop. One end of the loop can thus be engaged with the hook 47 while the other end is passed through the foot opening 36 and on rearwardly back to the hook 47. This arrangement is convenient for the user who may wish to remove the strap 46 for various reasons. In actual use, the user may wish to stretch the strap from the hook, around his ankle and back to the hook in order to attach the shoe more securely to his foot.

The snowshoe structure may be formed of various components of common vehicle rubber tire casings. In fact, the entire frame 11, including the reinforcing band 16, can be formed of the inside rim of a vehicle tire. In this case, the inner annular edge 15 would be comprised of the inside rim or "bead" of the tire. The outer annular edge 14 would be cut from the tire sidewall. A reinforcing band 16 is typically provided adjacent the bead in many vehicle tires.

The web 20 may be formed of an elongated strand cut from the tire sidewall. The elongated strand may be cut from the sidewall in a single strip by cutting a continuous spiral about the tire side-wall. The cut would begin outside the cut previously made to remove the frame 11. Sufficient length of the strand can be obtained from a single continuous cut on one side of a typical vehicle tire to produce the web 20 for one snowshoe. The rim and sidewall of the opposite tire side can be used to produce the mate (second snowshoe).

The web 20 is secured to the frame 11 firstly by drilling equally spaced holes about the frame periphery from the top surface 12 to the bottom surface 13. The single strand of webbing material is then threaded through these holes in the manner shown in FIGS. 1 and 3, using a simple, criss-cross type weave. The webbing and cleats are thus formed simultaneously. Opposite ends 22 and 23 of the strand are trimmed close to the frame when the weaving of the webbing is completed (see FIG. 1).

The next step is formation and attachment of the binding means 30. The binding means 30 can be cut directly from an inner tube. The resilient nature of the typical inner tube material and its waterproof characteristics are particularly suited for use as the binding means. Thus, the elongated sheet 31 may be cut from the inner tube, as well as the buttons or rosettes 40 and the strap 46.

The only materials in the snowshoe foreign to a vehicle tire may be the tie down cords 41 or grommets (if used) and the hook 47. The tie down cords used with rubber rosettes may be comprised of any animal or synthetic cord that is easily threaded through appropriate holes in the sheet 31 and rosettes 40. Similar cords used with grommet construction can be formed of the tire sidewall, as is the webbing. The hook 47 is formed of a rigid, preferably noncorrosive material that can be bent to clamp the frame in the manner shown in FIG. 2.

The present showshoe 10 can be provided in different sizes according to the weight of the wearer or combined weight with the load the wearer is to carry. I have found that most weight variations can be accommodated for by constructing shoes from vehicle tires of different sizes. For example, larger truck tires may be used, due to the larger diameter of the bead or inner annular edge 15, where excessive loads are to be carried. Smaller automotive tires can be used to produce snowshoes with lighter load carrying capabilities. Of course, it is preferable for the wearer to select the smallest diameter snowshoe that is capable of carrying his anticipated weight. This is done to avoid the extra weight and wider stance of the larger shoes.

To use the present snowshoes, the wearer simply inserts his boots through the foot openings 36 so the boot toes fit snugly against the toe pockets 35 of the binding means. The heels are then held slightly above the web 20 while the sheets 31 are stretched to pull the heel ends 34 over the boot heels. The back ends 38 of the foot openings are positioned on the wearer's boots upwardly of the heels and toward the ankles. Tension applied along the lengths of the stretched sheets serves to urge the boots into the toe pockets 35, while the hold down means 45 secure the snowshoes yieldably to the boot heels.

The wearer walks in the present snowshoes in a manner similar to that typically used for other forms of snowshoes, with the exception that the entire shoe is raised during each step. The hold down means 45 does not allow the rearward end of the shoe to drag along the snow surface as typically provided with other forms of snowshoes. Dragging of the heel becomes unnecessary due to the short length of the shoe. Furthermore, the hold down means 45 allows considerably better control of the snowshoes when walking or maneuvering in confined areas.

It is pointed out that the wearer's foot is substantially centered over the axis of the snowshoe frame. Therefore, he is able to pivot the shoe about the axis without lifting or otherwise awkwardly maneuvering his leg. This is a distinct advantage over prior forms of snowshoes which have an extended tail. With prior forms, the wearer must lift his leg and cross the snowshoe over the other in an awkward attempt to change direction. This is a difficult maneuver to accomplish and takes considerable time and effort.

Another important feature of the present snowshoe is the angular orientation of the bottom frame surface 13. The concave nature of this surface provides an annular "suction cup" form of gripping surface about the entire snowshoe periphery. This, coupled with the gripping feature of the cleats 28, assures a secure stance, even on a relatively severe incline.

When climbing becomes too steep even for positive grip by the frame and cleats, the snowshoer can "kick" his way up or down a hill simply by kicking the outer edge 14 horizontally into the snow to form a horizontal platform under the web on which he can rest his weight while the other foot is lifted and kicked into the snow. This procedure, unlike "kicking" procedures used with "bearpaw" snowshoes, can be accomplished in either an uphill or downhill direction. Prior "bearpaw" snowshoes are not easily used in this manner due to the long trailing tail and forward position of the bindings on the webbing.

The above description and attached drawings are given by way of example to set forth a preferred form of the present invention. Various other forms and modifications may be made that fall within the scope of the attached claims.

What I claim is:

1. A circular snowshoe, comprising:

an annular frame formed about a central axis, having axially spaced top and bottom surfaces joined by an inner annular edge and an outer annular edge concentric about the inner annular edge but spaced axially therefrom, said bottom surface facing angularly inward toward the central axis to enable the outer annular edge to bite into the snow;

a web spanning the annular frame and mounted thereto along the top surface thereof, the web being spaced axially from the bottom surface;

the web having a top surface facing upwardly and an oppositely facing bottom surface with a peripheral edge thereof overlapping the inner annular frame edge and engaging the top frame surface; and binding means on the top web surface for releasably securing the web and frame to a user's foot.

2. The snowshoe as claimed by claim 1 wherein the webbing is formed of a single elongated strand of resilient material and wherein the annular frame includes apertures spaced angularly about the central axis through which the strand is threaded to form the web.

3. The snowshoe as claimed by claim 1 wherein the circular frame and web are formed by a resilient material and further comprising:

an annular reinforcing band disposed within the circular frame.

4. The circular snowshoe as claimed by claim 1 wherein the binding means is comprised of:

an elongated sheet of resilient material having a toe end and a heel end;

wherein the toe end of the sheet is folded onto itself and attached to the webbing along opposed lateral sheet sides to form a toe pocket;

a foot access opening formed through the sheet extending from a front end adjacent the toe pocket and a back end adjacent the heel end of the sheet, adapted to receive the users foot and to urge the users toe into the toe pocket; and hold down means extending between the heel end of the sheet and the frame for yieldably resisting movement of the sheet heel end away from the webbing.

5. The snowshoe as claimed by claim 4 wherein the hold down means is comprised of a strap connected to the heel end of the sheet; and hook means on the annular frame for releasably connecting the strap to the frame.

6. The snowshoe as claimed by claim 1, further comprising cleats projecting downwardly from the bottom frame surface and spaced angularly about the central axis.

7. The snowshoe as claimed by claim 6 wherein the cleats are formed of short lengths of the web and are integral therewith.

8. A circular snowshoe formed of vehicle tire components, including a tire rim, sidewall, and innertube, comprising:

an annular frame formed on a central axis of the tire rim, said frame having top and bottom surface joined by an inner annular edge and an outer annular edge concentric about the inner annular edge but spaced axially therefrom;

a web on the top surface spanning the annular frame, the web being comprised of an elongated narrow strip cut from the sidewall of the tire and threaded through apertures formed through the annular frame; and binding means mounted to the web and formed of a section of innertube for receiving the users foot and for releasably attaching the frame and web to the user's foot.

9. The circular snowshoe as claimed by claim 8 wherein the binding means is comprised of:

an elongated sheet of resilient material having a toe end and a heel end;

wherein the toe end of the sheet is folded onto itself and attached to the webbing along opposed lateral sheet sides to form a toe pocket;

a foot access opening formed through the sheet extending from a front end adjacent the toe pocket and a back end adjacent the heel end of the sheet, adapted to receive the users foot and to urge the users toe into the toe pocket; and hold down means extending between the heel end of the sheet and the frame for yieldably resisting movement of the sheet heel end away from the webbing.

10. The snowshoe as claimed by claim 8, further comprising cleats projecting downwardly from the bottom frame surface and spaced angularly about the central axis.

* * * * *